US010760801B2

(12) United States Patent
Shima et al.

(10) Patent No.: US 10,760,801 B2
(45) Date of Patent: Sep. 1, 2020

(54) VENTILATOR AND METHOD OF MANUFACTURING VENTILATOR

(71) Applicant: Panasonic Intellectual Property Management Co., Ltd., Osaka (JP)

(72) Inventors: Yasuaki Shima, Aichi (JP); Daisuke Kanematsu, Aichi (JP); Shogo Maeda, Kagoshima (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 242 days.

(21) Appl. No.: 15/900,998

(22) Filed: Feb. 21, 2018

(65) Prior Publication Data

US 2018/0245808 A1 Aug. 30, 2018

(30) Foreign Application Priority Data

Feb. 28, 2017 (JP) ..... 2017-036225
Dec. 18, 2017 (JP) ..... 2017-241285

(51) Int. Cl.
*F24F 7/02* (2006.01)
*F24F 7/00* (2006.01)

(52) U.S. Cl.
CPC ..... *F24F 7/025* (2013.01); *F24F 2007/001* (2013.01); *F24F 2221/14* (2013.01)

(58) Field of Classification Search
CPC ... F24F 7/025; F24F 2007/001; F24F 2221/14
USPC ..... 454/354
See application file for complete search history.

(56) References Cited

U.S. PATENT DOCUMENTS 3,939,506 A * 2/1976 Pearson ..... E03D 9/04 4/213
6,261,175 B1 * 7/2001 Larson ..... F24F 7/007 415/204
6,979,169 B2 * 12/2005 Penlesky ..... F04D 29/4226 415/1
8,876,582 B2 * 11/2014 Gao ..... F24F 7/007 454/341
9,416,989 B1 * 8/2016 Tom ..... F24F 13/078
9,746,196 B2 * 8/2017 Su ..... F24F 7/007
(Continued)

FOREIGN PATENT DOCUMENTS

JP 5408329 B2 2/2014

*Primary Examiner* — Edelmira Bosques
*Assistant Examiner* — Dana K Tighe
(74) *Attorney, Agent, or Firm* — Pearne & Gordon LLP

(57) ABSTRACT

A ventilator includes a body part with a box shape, an adapter plate provided on one surface of the body part, a blowing part, and an adapter provided on the adapter plate. The adapter includes a connection surface connected to the adapter plate, and a cylindrical outer peripheral wall rising perpendicularly from the connection surface. The adapter plate includes a first hook part, a second hook part, a first caulking joint part, and a second caulking joint part. The first hook part and the second hook part restrict the connection surface to slide in a horizontal direction, while restricting the connection surface to move in a direction away from the adapter plate in the restriction condition. The adapter plate and the connection surface are overlapped with each other to be joined by the first caulking joint part and the second caulking joint part.

6 Claims, 5 Drawing Sheets

(56) References Cited

U.S. PATENT DOCUMENTS

2008/0318515 A1* 12/2008 Yeung ..... F04D 29/4206
454/354
2009/0170421 A1* 7/2009 Adrian ..... F24F 7/06
454/349

* cited by examiner

VENTILATOR AND METHOD OF MANUFACTURING VENTILATOR

BACKGROUND OF THE INVENTION

1. Field of the Invention

The present disclosure relates to a ventilator and a method of manufacturing the ventilator.

2. Description of the Related Art

In the conventional ventilator and a method of manufacturing the ventilator, there is known a ventilator of which an adapter plate and an adapter are joined by welding or fixed with a screw, as described in Japanese Patent No. 5408329.

In such a conventional ventilator and the method of manufacturing the ventilator, if an exhaust air duct attached to the adapter applies a load by its own weight, a gap may disadvantageously occur between the adapter and the adapter plate to cause a possible wind leak, for example.

The present disclosure, which solves the above-mentioned conventional problem, aims to provide a ventilator capable of preventing a wind leak by joining between the adapter and the adapter plate tightly, and a method of manufacturing the ventilator.

SUMMARY OF THE INVENTION

To achieve the aim, the ventilator in accordance with one aspect of the present disclosure includes a body part with a box shape having a suction opening, an adapter plate with a flat plate shape that has a blowout opening and is provided on one surface of the body part, a blowing part that guides air to the blowout opening from the suction opening, and an adapter provided on the adapter plate to connect the blowout opening and an exhaust air duct. The adapter includes a connection surface connected to the adapter plate, and a cylindrical outer peripheral wall rising perpendicularly from the connection surface. The connection surface and the outer peripheral wall are integrally formed of a metal material. The adapter plate includes a first hook part, a second hook part, a first caulking joint part, and a second caulking joint part. The first hook part is provided in an outer periphery of the blowout opening and restricts the connection surface to slide in one direction, while restricting the connection surface to move in a direction away from the adapter plate in the restriction condition. The second hook part is provided in the outer periphery of the blowout opening and restricts the connection surface to slide in another direction intersecting with the one direction perpendicularly, while restricting the connection surface to move in the direction away from the adapter plate in the restriction condition. The first caulking joint part is provided in a side that is located in the outer periphery of the blowout opening and faces the first hook part across the blowout opening, and joins the adapter plate and the connection surface in the state where the adapter plate and the connection surface are overlapped with each other. The second caulking joint part is provided in a side that is located in the outer periphery of the blowout opening and faces the second hook part across the blowout opening, and joins the adapter plate and the connection surface in the state where the adapter plate and the connection surface are overlapped with each other.

Further, the method of manufacturing the ventilator in accordance with one aspect of the present disclosure includes a body part with a box shape having a suction opening, an adapter plate with a flat plate shape that has a blowout opening and is provided on one surface of the body part, a blowing part that guides air to the blowout opening from the suction opening, and an adapter provided on the adapter plate to connect the blowout opening and an exhaust air duct. The adapter includes a connection surface connected to the adapter plate, and a cylindrical outer peripheral wall rising perpendicularly from the connection surface. The connection surface and the outer peripheral wall are integrally formed of a metal material. The adapter plate includes a first hook part, a second hook part, a first caulking joint part, and a second caulking joint part. The first hook part is provided in an outer periphery of the blowout opening and restricts the connection surface to slide in one direction, while restricting the connection surface to move in a direction away from the adapter plate in the restriction condition. The second hook part is provided in the outer periphery of the blowout opening and restricts the connection surface to slide in another direction intersecting with the one direction perpendicularly, while restricting the connection surface to move in the direction away from the adapter plate in the restriction condition. The first caulking joint part is provided in a side that is located in the outer periphery of the blowout opening and faces the first hook part across the blowout opening, and joins the adapter plate and the connection surface in the state where the adapter plate and the connection surface are overlapped with each other. The second caulking joint part is provided in a side that is located in the outer periphery of the blowout opening and faces the second hook part across the blowout opening, and joins the adapter plate and the connection surface in the state where the adapter plate and the connection surface are overlapped with each other. The method of manufacturing the ventilator performs the caulking of the first caulking joint part, the caulking of the second caulking joint part, the pressure bonding in the first hook part, and the pressure bonding in the second hook part simultaneously. Thus, the intended aim is achieved.

According to the present disclosure, the connection surface of the adapter is inserted into the first hook part and the second hook part of an adapter plate, and then pressure-bonded. The adapter and the adapter plate are joined by the first caulking joint part and the second caulking joint part in the state where the adapter plate and the connection surface of the adapter are overlapped with each other. Thus, the adapter and the adapter plate are joined tightly, thereby making it possible to prevent a wind leak.

Further, the connection surface of the adapter is inserted into the first hook part and the second hook part of the adapter plate, and then caulked and pressure-bonded simultaneously by using the first caulking joint part and the second caulking joint part, in the state where the adapter plate and the connection surface of the adapter are overlapped with each other. The caulking and the pressure-bonding are performed simultaneously to join the adapter and the adapter plate, thereby making it possible to simplify the working process.

DETAILED DESCRIPTION OF THE PREFERRED EMBODIMENT(S)

Hereinafter, an exemplary embodiment of the present disclosure will be described with reference to the drawings.

Exemplary Embodiment

Figure 1:
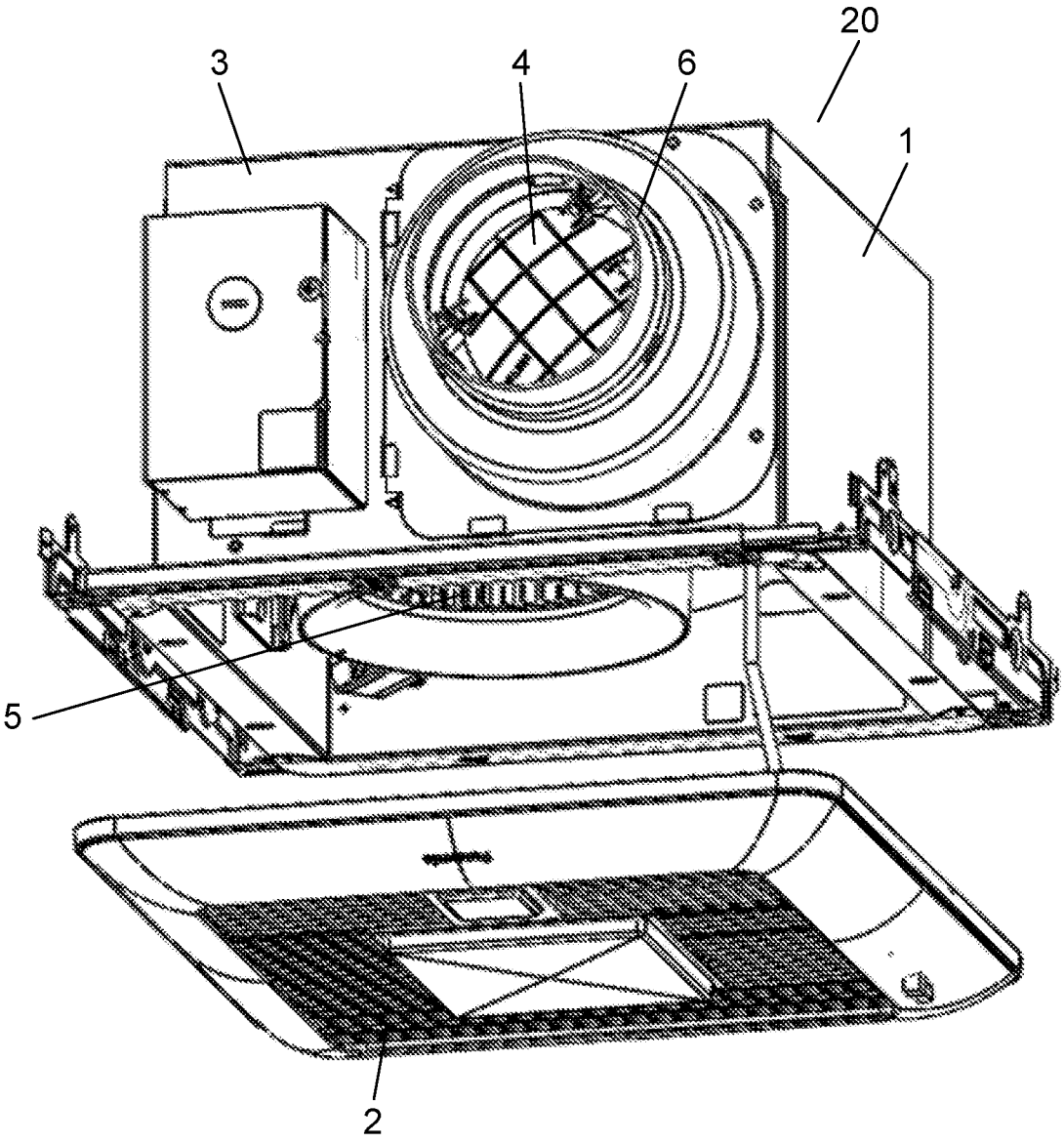
FIG. 1 is a schematic perspective view showing a ventilator in accordance with an exemplary embodiment of the present disclosure.

FIG. 1 is a schematic perspective view showing a ventilator in accordance with an exemplary embodiment of the present disclosure.

Ventilator 20 in accordance with the exemplary embodiment is installed in, for example, an indoor ceiling, and used for discharging indoor air to the outside.

As shown in FIG. 1, ventilator 20 includes body part 1, adapter plate 3, blowing part 5, and adapter 6. Body part 1 is box-shaped, and has suction opening 2. Adapter plate 3, which has a flat plate shape, has blowout opening 4 and is provided on one surface of lateral sides of body part 1. Blowing part 5 is built in body part 1, and guides air to blowout opening 4 from suction opening 2. Adapter 6, which is provided on adapter plate 3, connects blowout opening 4 and an exhaust air duct. In other words, in the state where ventilator 20 is installed, the exhaust air duct is usually connected to adapter 6.

Blowing part 5 is, for example, a sirocco fan having a scroll casing. The sirocco fan is rotated by supplying electric power. When blowing part 5 operates, indoor air is sucked from suction opening 2. The sucked indoor air is discharged to the outside through blowing part 5, adapter 6, and the exhaust air duct.

Figure 2:
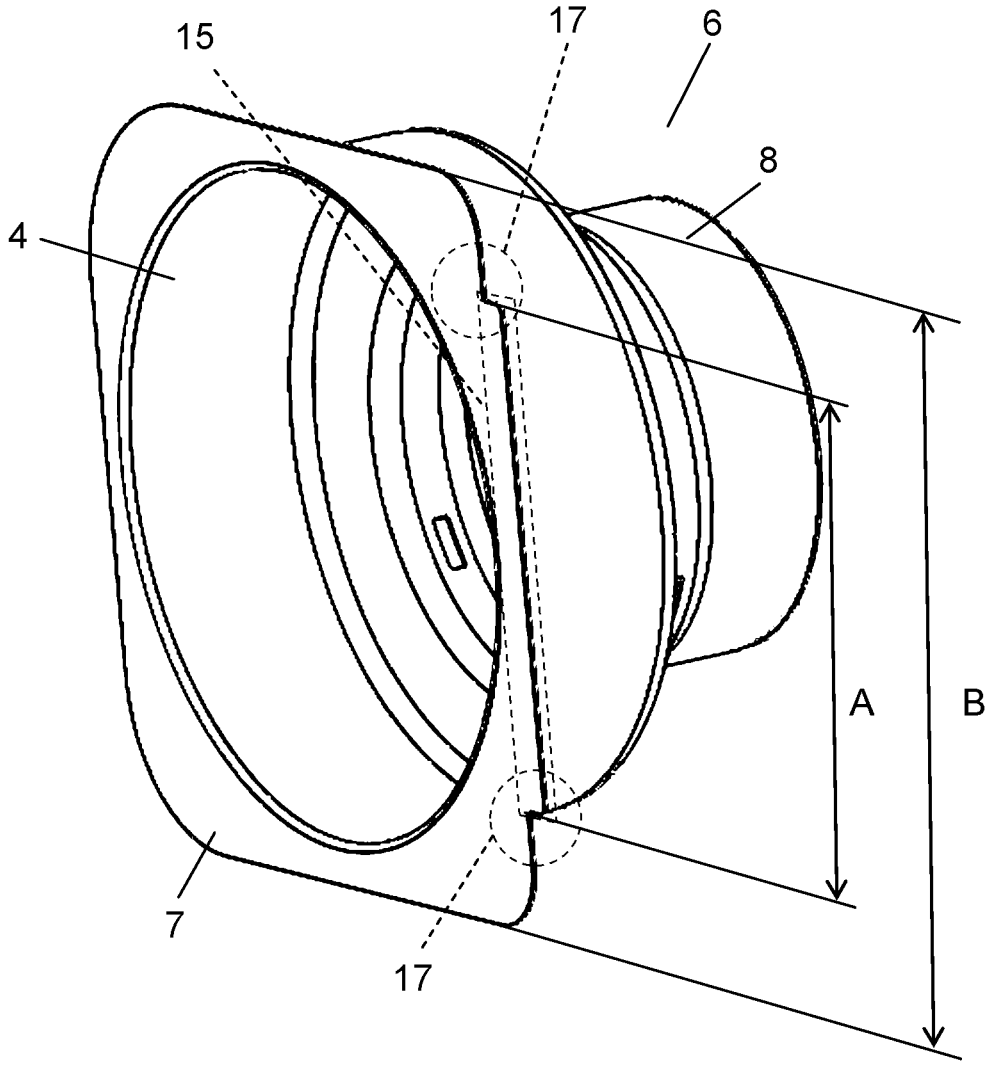
FIG. 2 is a schematic perspective view showing an adapter in accordance with the exemplary embodiment.

FIG. 2 is a schematic perspective view showing an adapter in accordance with the exemplary embodiment.

As shown in FIG. 2, adapter 6 is constituted by connection surface 7 having a flat plate shape, and cylindrical outer peripheral wall 8 rising perpendicularly from connection surface 7. According to the present exemplary embodiment, connection surface 7 has a substantially rectangular shape whose four corners are rounded or the like. When ventilator 20 is installed, the exhaust air duct is connected to outer peripheral wall 8. Adapter 6 is made of a metal material, and connection surface 7 and outer peripheral wall 8 are molded integrally. For instance, a sheet of metal plate is subjected to a drawing process to mold adapter 6. Accordingly, thick and thin portions are produced in molded adapter 6, i.e., the thickness differs depending on location.

Connection surface 7 includes pressure-bonding side 15 projected from one side of connection surface 7 on the same surface as connection surface 7, i.e., on connection surface 7. Pressure-bonding side 15, which is a rectangular plate projected from one side of connection surface 7, is pressure-bonded with first hook part 9 described later. Since pressure-bonding side 15 is projected from one side of connection surface 7, both ends 17 of pressure-bonding side 15 are recessed toward blowout opening 4, i.e., an opening side. Further, as shown in FIG. 2, in the present exemplary embodiment, length A of one side of pressure-bonding side 15 is shorter than length B of one side of connection surface 7.

Figure 3:
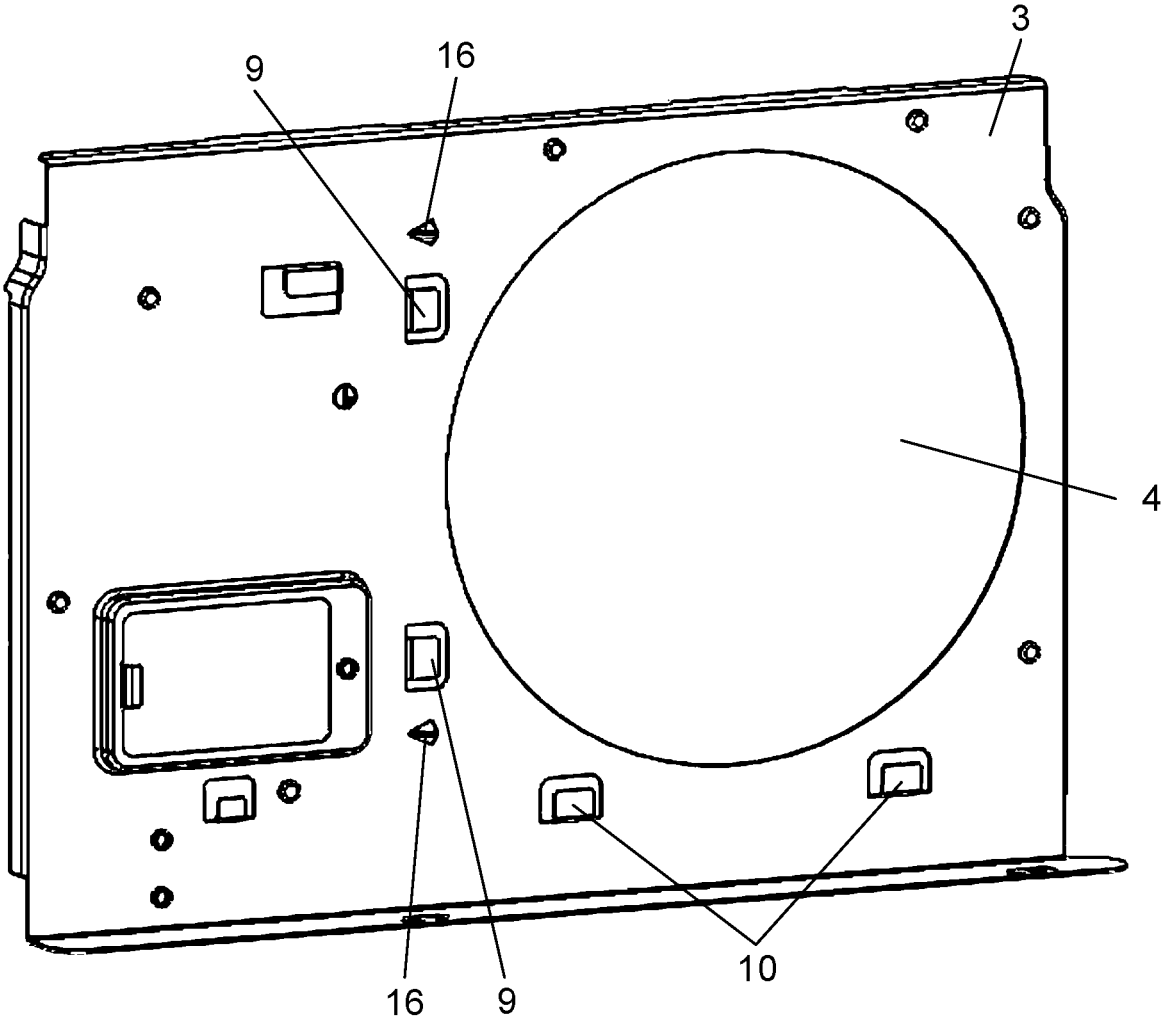
FIG. 3 is a schematic perspective view showing an adapter plate in accordance with the exemplary embodiment.
Figure 4A:
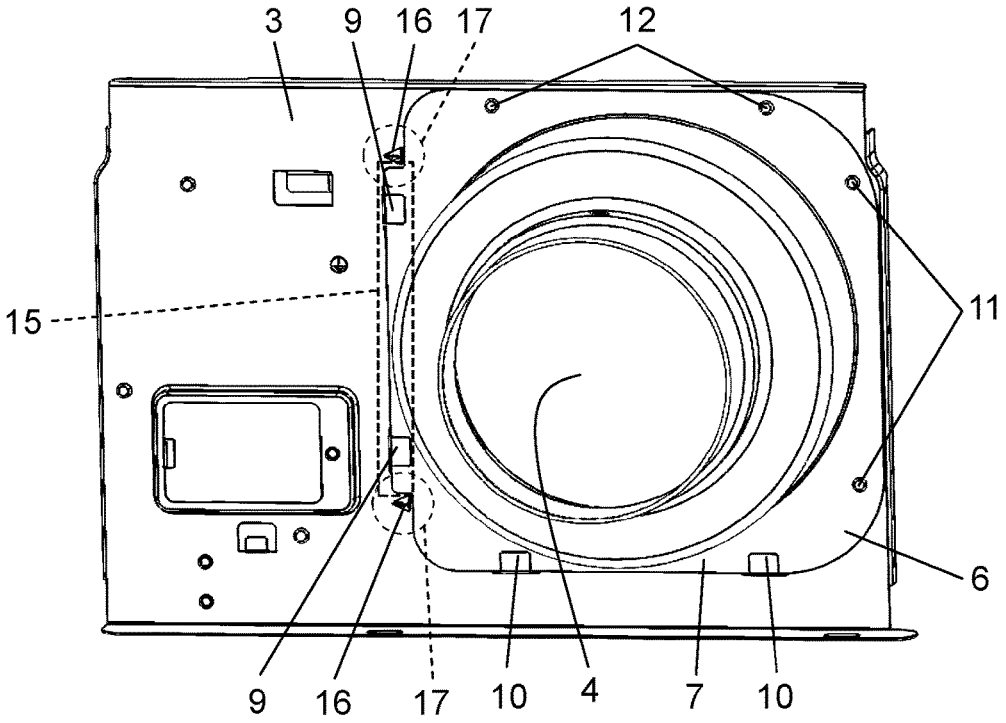
FIG. 4A is a perspective view showing the state where the adapter plate and the adapter in accordance with the exemplary embodiment are connected.
Figure 4B:
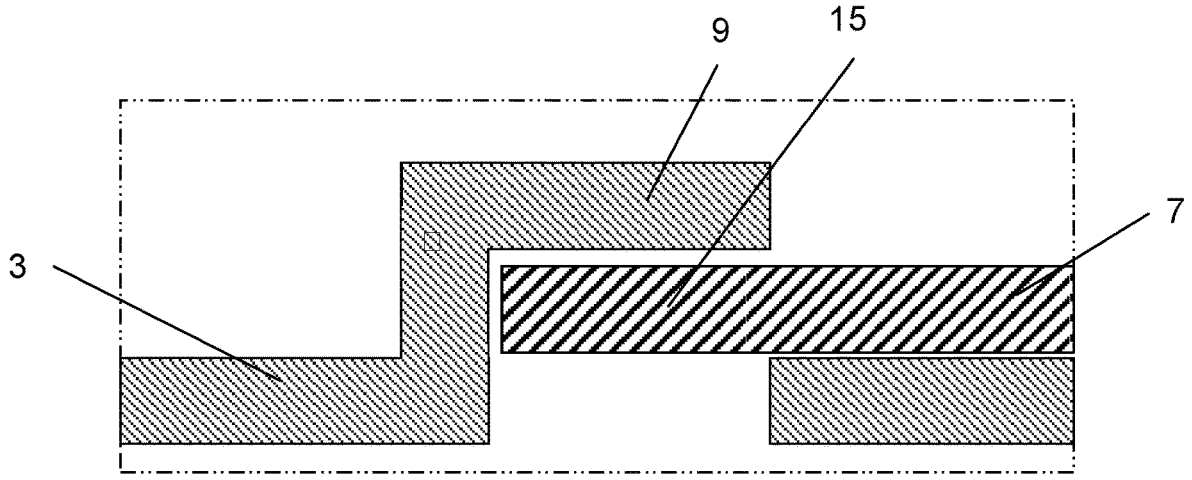
FIG. 4B is a cross-sectional view showing the state where the adapter plate and the adapter in accordance with the exemplary embodiment are connected.

FIG. 3 is a schematic perspective view showing an adapter plate in accordance with the exemplary embodiment. FIG. 4A is a perspective view showing the state where the adapter plate and the adapter in accordance with the exemplary embodiment are connected. FIG. 4B is a cross-sectional view showing the state where the adapter plate and the adapter in accordance with the exemplary embodiment are connected.

Adapter plate 3 is molded of a metal material. As shown in FIGS. 3 and 4A, adapter plate 3 has a plurality (two in the exemplary embodiment) of first hook parts 9, and a plurality (two in the exemplary embodiment) of second hook parts 10.

First hook parts 9 are provided in the outer periphery of blowout opening 4, corresponding to one side of connection surface 7 of adapter 6. Alternatively, it can be said that first hook parts 9 are provided corresponding to pressure-bonding side 15. "Provided corresponding to something," described herein, means that first hook parts 9 are aligned with the position at which the one side of connection surface 7 is to be located when adapter 6 is mounted on adapter plate 3. Note that, as shown in FIG. 4B, first hook part 9 is a projection formed such that adapter plate 3 is partially cut and raised to have an L-shape cross-section. Therefore, when adapter 6 is mounted on adapter plate 3, pressure-bonding side 15 projected from the one side of connection surface 7 is inserted under first hook part 9. In other words, first hook part 9 is shaped to restrict connection surface 7 to slide in one direction (leftward direction in FIG. 4B) when adapter 6 is mounted on adapter plate 3, while also restricting connection surface 7 to move in a direction away from adapter plate 3 (upward direction in FIG. 4B) in the restriction condition.

Second hook part 10 is provided in the outer periphery of blowout opening 4, corresponding to a side adjacent to the one side, which corresponds to first hook part 9, of connection surface 7 of adapter 6. In other words, second hook part 10 is provided corresponding to the side adjacent to the one side including pressure-bonding side 15. Note that, "provided corresponding to something," described herein, means that second hook part 9 is aligned with the position at which the side adjacent to the one side, which corresponds to first hook part 9, of connection surface 7 is to be located when adapter 6 is mounted on adapter plate 3. Further, like first hook part 9, second hook part 10 is a projection formed such that adapter plate 3 is partially cut and raised to have an L shape cross-section. In other words, when adapter 6 is mounted, second hook part 10 restricts connection surface 7 to slide in another direction (downward direction in FIG. 3) intersecting with the one direction perpendicularly, while also restricting connection surface 7 to move in a direction (upward direction in FIG. 4B) away from adapter plate 3 in the restriction condition. In other words, the direction in which first hook part 9 restricts connection surface 7 to slide and the direction in which second hook part 10 restricts connection surface 7 to slide intersect with each other, perpendicularly. Further, the direction in which first hook part 9 restricts connection surface 7 to move in the restriction condition and the direction in which second hook part 10 restricts connection surface 7 to move in the restriction condition are in agreement with a direction in which connection surface 7 is separated from adapter plate 3.

Adapter plate 3 further includes projection parts 16 that are projected in the same direction (near side direction in FIG. 3) as a direction in which first hook part 9 and second hook part 10 are projected from connection surface 7.

Projection parts 16 are provided on both sides of first hook parts 9 in a vertical direction of FIG. 3. Both ends 17 of pressure-bonding side 15 are interposed between projection parts 16 in the state where adapter 6 is mounted on adapter plate 3. Thus, projection parts 16 restrict pressure-bonding side 15 to move in the vertical direction of FIG. 3. In other words, in the state where adapter 6 is mounted on adapter plate 3, projection parts 16 restrict adapter 6 to move in the vertical direction of FIG. 3. Projection parts 16 have height twice a thickness of connection surface 7 or more. The height described herein is a height when connection surface 7 is defined as a bottom surface.

As shown in FIGS. 4A and 4B, when adapter 6 is mounted on adapter plate 3, pressure-bonding side 15, which serves as the one side of connection surface 7, is inserted into first hook part 9. At this time, pressure-bonding side 15 is interposed between projection parts 16, so that adapter 6 is restricted to move in a vertical direction of FIG. 4A. Pressure-bonding side 15, which is projected from the one side of connection surface 7, has both ends 17. Furthermore, projection parts 16 are provided on both sides of first hook part 9. In the present exemplary embodiment, two projection parts 16 are provided, and a length between two projection parts 16 is longer than length A shown in FIG. 2, and shorter than length B. For this reason, the one side including pressure-bonding side 15 is allowed to be inserted into the first hook part 9, but other sides are not allowed to be inserted into first hook part 9. In other word, it can be said that projection parts 16 restrict connection surface 7 to move to a first hook part 9 side (left-hand side in FIG. 4A) on both sides of first hook part 9. For this reason, if an operator tries to insert the other sides into first hook part 9 by mistake, it will be difficult for the other sides, which are not projected, to reach first hook part 9. Thus, the operator can recognize the mistake easily.

Further, since adapter 6 is molded by drawing, the thickness thereof is not uniform. Therefore, the periphery of connection surface 7, i.e., a flange part may be bent backwardly. For instance, in the case where the other side, which does not include pressure-bonding side 15, is backwardly bent at the position corresponding to projection part 16, if the other side is inserted into first hook part 9 by mistake, the other side will climb projection part 16 and be inserted into first hook part 9. In other words, if an operator tires to insert the other side into first hook part 9 by mistake, the other side may be partially inserted into first hook part 9 in normal manner. However, in the case where the other side is bent backwardly at the position corresponding to projection part 16, it may climb projection part 16. By contrast, in the present exemplary embodiment, projection part 16 has height twice a thickness of connection surface 7. Accordingly, even when connection surface 7 is bent, the other side is hard to climb projection part 16. In other words, this makes it possible to prevent such incorrect insertion that the other side is inserted into first hook part 9 by mistake.

Further, a side adjacent to the one side including pressure-bonding side 15 is inserted into second hook part 10. The description of inserting the side into second hook part 10 is omitted because it is almost the same as the above-mentioned insertion, only except that no projection part 16 is provided. In this way, adapter 6 is restricted to a predetermined position relative to adapter plate 3.

In the state where adapter 6 is restricted to the predetermined position relative to adapter plate 3, first hook part 9 and second hook part 10 are pressure-bonded from the back and front. Thus, adapter 6 and adapter plate 3 are joined more tightly.

Next, it will be described that, in adapter 6, a side that faces the side inserted into first hook part 9 and a side that faces the side inserted into second hook part 10 are fixed.

In the state where adapter plate 3 and connection surface 7 are overlapped with each other, a side that faces the side inserted into first hook part 9 across blowout opening 4 is fixed by caulking from the back and front. The caulking produces first caulking joint part 11. In the present exemplary embodiment, two first caulking joint parts 11 are provided. The caulking will be described in detail later.

Likewise, in the state where adapter plate 3 and connection surface 7 are overlapped with each other, a side that faces the side inserted into second hook part 10 across blowout opening 4 is fixed by caulking from the back and front. The caulking produces second caulking joint part 12. In the present exemplary embodiment, two second caulking joint parts 12 are provided.

In this way, connection surface 7 of adapter 6 and adapter plate 3 are pressure-bonded to each other, and fixed by caulking. This eliminates a gap between adapter 6 and adapter plate 3, thereby making it possible to prevent a wind leak. For instance, even if an exhaust air duct acts on adapter 6 as a load, a gap will not occur between adapter 6 and adapter plate 3 because adapter 6 and adapter plates 3 are joined tightly.

Further, a direction in which first caulking joint part 11 and second caulking joint part 12 are caulked, and a direction in which first hook part 9 and second hook part 10 are pressure-bonded are the same, i.e., the caulking and the pressure-bonding are performed from the back and front. In other words, adapter plate 3 and connection surface 7 are caulked and pressure-bonded vertically from the back and front. Accordingly, the caulking and the pressure-bonding can be performed simultaneously by using a press machine or the like, thereby making it possible to reduce man-hours.

Figure 5:
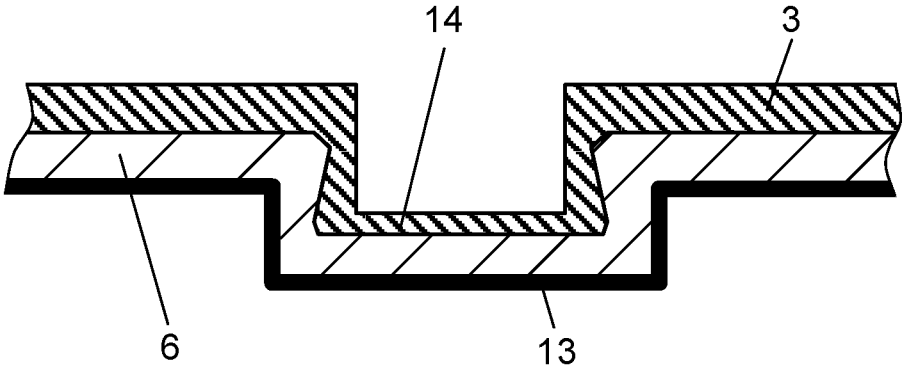
FIG. 5 is a view showing the state where a first caulking joint part and a second caulking joint part in accordance with the exemplary embodiment are caulked.

FIG. 5 is a view showing the state where the first caulking joint part and the second caulking joint part in accordance with the present exemplary embodiment are caulked.

In FIG. 5, adapter 6 and adapter plate 3 are caulked by using a press metallic mold. Specifically, cylindrical depression part 13 and cylindrical projection part 14 are fitted into each other to caulk adapter 6 and adapter plate 3. Herein, projection part 14 is formed on an adapter plate 3 side, and depression part 13 is formed on an adapter 6 side. Projection part 14 on adapter plate 3 is inserted into depression part 13 inside adapter 6 (inner side of body part 1).

The projection for caulking is directed to the outside of the body. In other words, projection part 14 may be formed so as to bulge to the outside of body part 1. When adapter 6 is viewed from the outside, depression part 13 is projected outwardly, but not projected to the inside of body part 1. Accordingly, depression part 13 is avoided from interfering with inner structure of body part 1, thereby making it possible to improve assemble ability and maintenance ability of body part 1.

Further, to secure quality of the caulking, outer dimensional inspection of a caulking part is essential. Through a process in which adapter 6 is subjected to integral draw forming, the thickness of a material is made uneven, so that the inspection of each caulking part (first caulking joint part 11 and second caulking joint part 12) is necessary. Accordingly, the number of caulking parts is reduced to decrease inspection man-hours. Further, the caulking of first caulking joint part 11 and second caulking joint part 12, and the pressure-bonding of first hook part 9 and second hook part 10 are performed simultaneously. Thus, mass-produce ability is improved reasonably.

The ventilator in accordance with the present disclosure and the method of manufacturing the ventilator are applicable to a home use ventilator, a ventilator for buildings, or the like.

What is claimed is:

1. A ventilator comprising:

a body part with a box shape having a suction opening;

an adapter plate with a flat plate shape that has a blowout opening and is provided on one surface of the body part;

a blowing part that guides air to the blowout opening from the suction opening; and an adapter that is provided on the adapter plate to connect the blowout opening and an exhaust air duct, wherein the adapter includes:

a connection surface connected to the adapter plate; and a cylindrical outer peripheral wall rising perpendicularly from the connection surface, wherein the connection surface and the outer peripheral wall are integrally formed of a metal material, and the adapter plate includes:

a first hook part that is provided in an outer periphery of the blowout opening, corresponding to a side of the connection surface, is a first projection formed such that the adapter plate is partially cut and raised to have an L shape cross section and restricts the connection surface to slide in one direction, while restricting the connection surface to move in a direction away from the adapter plate in a restriction condition;

a second hook part that is provided in the outer periphery of the blowout opening, corresponding to the side of the connection surface, is a second projection formed such that the adapter plate is partially cut and raised to have an L shape cross section and restricts the connection surface to slide in another direction intersecting with the one direction perpendicularly, while restricting the connection surface to move in the direction away from the adapter plate in the restriction condition;

a first caulking joint part that is provided in a side located in the outer periphery of the blowout opening and facing the first hook part across the blowout opening, and joins the adapter plate and the connection surface in a state where the adapter plate and the connection surface are overlapped with each other; and a second caulking joint part that is provided in a side located in the outer periphery of the blowout opening and facing the second hook part across the blowout opening, and joins the adapter plate and the connection surface in the state where the adapter plate and the connection surface are overlapped with each other, wherein the first hook part restricts the connection surface to move in a direction away from the adapter plate when the connection surface is inserted under the first projection, and wherein the second hook part restricts the connection surface to move in the direction away from the adapter plate when the connection surface is inserted under the second projection.

2. The ventilator according to claim 1, wherein the first hook part and the second hook part are fixed in the state where the adapter plate and the connection surface are pressure-bonded to each other.

3. The ventilator according to claim 1, wherein a direction in which the first caulking joint part and the second caulking joint part are caulked and a direction in which the first hook part and the second hook part are pressure-bonded are identical.

4. The ventilator according to claim 1, wherein the connection surface includes a pressure-bonding side that is projected from the one side of the connection surface on the connection surface and pressure-bonded by the first hook part, and the adapter plate includes projection parts projected from a plane of the adapter plate, wherein the pressure-bonding side is interposed between the projection parts provided on both sides of the first hook part.

5. The ventilator according to claim 4, wherein the projection parts have height twice a thickness of the connection surface or more.

6. A method of manufacturing a ventilator comprising:

a body part with a box shape having a suction opening;

an adapter plate with a flat plate shape that has a blowout opening and is provided on one surface of the body part;

a blowing part that guides air to the blowout opening from the suction opening; and an adapter that is provided on the adapter plate to connect the blowout opening and an exhaust air duct, wherein the adapter includes:

a connection surface connected to the adapter plate; and a cylindrical outer peripheral wall rising perpendicularly from the connection surface, wherein the connection surface and the outer peripheral wall are integrally formed of a metal material, and the adapter plate includes:

a first hook part that is provided in an outer periphery of the blowout opening and restricts the connection surface to slide in one direction, while restricting the connection surface to move in a direction away from the adapter plate in a restriction condition;

a second hook part that is provided in the outer periphery of the blowout opening and restricts the connection surface to slide in another direction intersecting with the one direction perpendicularly, while restricting the connection surface to move in the direction away from the adapter plate in the restriction condition;

a first caulking joint part that is provided in a side located in the outer periphery of the blowout opening and facing the first hook part across the blowout opening, and joins the adapter plate and the connection surface in a state where the adapter plate and the connection surface are overlapped with each other; and a second caulking joint part that is provided in a side located in the outer periphery of the blowout opening and facing the second hook part across the blowout opening, and joins the adapter plate and the connection surface in the state where the adapter plate and the connection surface are overlapped with each other, the method comprising simultaneously performing the caulking of the first caulking joint part, the caulking of the second caulking joint part, the pressure-bonding in the first hook part, and the pressure-bonding in the second hook part by caulking and pressure-bonding the adapter plate and the connection surface vertically from back and front of the connection surface.

* * * * *